US006496584B2

(12) United States Patent
Irwan et al.

(10) Patent No.: US 6,496,584 B2
(45) Date of Patent: Dec. 17, 2002

(54) MULTI-CHANNEL STEREO CONVERTER FOR DERIVING A STEREO SURROUND AND/OR AUDIO CENTER SIGNAL

(75) Inventors: Roy Irwan, Eindhoven (NL); Ronaldus Maria Aarts, Eindhoven (NL)

(73) Assignee: Koninklijke Philips Electronics N.V., Eindoven (NL)

( * ) Notice: Subject to any disclaimer, the term of this patent is extended or adjusted under 35 U.S.C. 154(b) by 0 days.

(21) Appl. No.: 09/908,198

(22) Filed: Jul. 18, 2001

(65) Prior Publication Data

US 2002/0037086 A1 Mar. 28, 2002

(30) Foreign Application Priority Data

Jul. 19, 2000 (EP) ..... 00202588

(51) Int. Cl.[7] ..... H04R 5/00; H04R 5/02; H04H 5/00

(52) U.S. Cl. ..... 381/18; 381/12; 381/307

(58) Field of Search ..... 381/307

(56) References Cited

U.S. PATENT DOCUMENTS 5,426,702 A 6/1995 Aarts ..... 381/27
5,796,844 A * 8/1998 Griesinger ..... 381/18

* cited by examiner

*Primary Examiner*—Forester W. Isen
*Assistant Examiner*—Elizabeth McChesney
(74) *Attorney, Agent, or Firm*—Jack D. Slobod

(57) ABSTRACT

A multi-channel stereo converter is described comprising stereo magnitude determining means for generating a stereo information signal (a/b; ρ), which represents a degree of stereo between audio input signals (L, R), and transforming means for transforming said audio signals (L, R) based on said stereo information signal (a/b; ρ) into at least a surround signal (S). A space mapping interpretation is presented and an audio center signal may be derived from the stereo input signals as well. The result is more flexibility in application and design, without substantial cross talk in the audio signals.

9 Claims, 2 Drawing Sheets

MULTI-CHANNEL STEREO CONVERTER FOR DERIVING A STEREO SURROUND AND/OR AUDIO CENTER SIGNAL

BACKGROUND OF THE INVENTION

The present invention relates to a multi-channel stereo converter, comprising stereo means for generating an information signal from stereophonic audio signals (L, R) and transforming means coupled to the stereo means for transforming said audio signals (L, R) to a further audio signal (C; S).

The present invention also relates to a method for generating audio signals from stereophonic audio signals (L, R), wherein an information signal is derived from said audio signals (L, R) and used for transforming said audio signals (L, R) to such an audio signal (S).

Such a multi-channel stereo system and method are known from U.S. Pat. No. 5,426,702. The known system comprises stereo means in the form of a direction detection circuit for generating an information signal, which is derived from stereophonic audio input signals (L, R). The information signal contains a weighting factor measure for the direction of a most powerful sound source. Furthermore the known converter system comprises transforming means coupled to the direction detection circuit for transforming said audio signals (L, R) to a further audio signal in the form of an audio centre signal.

It is a disadvantage of the known multi-channel converter and method that no provisions are made to generate surround audio signals.

SUMMARY OF THE INVENTION

Therefore it is an object of the present invention to provide a multi-channel stereo converter system and corresponding method capable of generating and handling a variety of auxiliary audio signals, such as surround, stereo surround and/or centre signals, without substantial cross talk between these auxiliary audio signals.

Thereto the multi-channel stereo converter according to the invention is characterized in that the stereo means are stereo magnitude determining means for generating a stereo information signal (a/b; ρ), which represents a degree of stereo between said audio signals (L, R), and that the transforming means are embodied for transforming said audio signals (L, R) based on said stereo information signal (a/b; ρ) into at least a surround signal (S).

Similarly the method according to the invention is characterized in that the information signal is a stereo information signal (a/b; ρ), which represents a degree of stereo between said audio signals (L, R), and that based on said stereo information signal (a/b; ρ) said audio signals (L, R) are transformed into at least a surround signal (S).

It is an advantage of the multi-channel stereo converter and method according to the present invention that it is capable of generating additional related audio signals, such as surround signals, and left and right stereo surround signals, and/or at wish an audio centre signal, based on the two stereophonic left (L) and right (R) audio signals. This gives a large degree of freedom both in application possibilities and design, without substantial cross talk between output audio signals.

An embodiment of the stereo converter according to the present invention characterized in that the transforming means use a relation for said transformation which maps the stereo information signal (a/b; ρ) to an angle (β) onto an audio signals defined plane. In a very simple to implement embodiment said transformation uses a goniometric relation. In practice one would consider the use of some transformation which maps the stereo information signal (a/b; ρ) to the angle (β), where this angle is between 0 and π/2.

A particular embodiment of the multi-channel stereo converter according to the invention is characterized in that the transforming means are embodied for additionally transforming said audio signals (L, R) from an orthogonal representation to a representation, wherein said audio signals (L, R) lie on a straight line, thus revealing an additional audio centre signal (C).

Advantageously this embodiment provides for a multi-channel configuration having available audio left (L), right (R), surround (S) or surround left ($S_L$) and surround right ($S_R$), and the audio centre signal (C).

Advantageously a vector multiplication with a multiple which lies around two, can in particular with a matrix transformation be implemented easily on chip. In a further embodiment of the multi-channel stereo converter according to the invention matrix coefficients of said matrix transformation are based on projections of an actual audio signal on principal axes of the audio signals (R, L, C, S), either or not combined with other coefficients, such as empirically determined coefficients, to cover for example Dolby® Surround, Dolby Pro Logic®, Circle Surround®, and Lexicon® systems and other surround systems.

In practice a still further embodiment of the multi-channel stereo converter according to the invention is characterized in that the stereo converter is provided with one or more decorrelation filters, for example Lauridsen decorrelation filters, to which filters the stereo surround signal (S) are applied for generating a stereo surround left signal ($S_L$) and a stereo surround right signal ($S_R$). These kind of decorrelation filters are readily available on the market.

BRIEF DESRCIPTION OF THE DRAWINGS

At present the multi-channel stereo converter and corresponding method according to the invention will be elucidated further together with their additional advantages while reference is being made to the appended drawing, wherein similar components are being referred to by means of the same reference numerals. In the drawing.

Figure 3A:
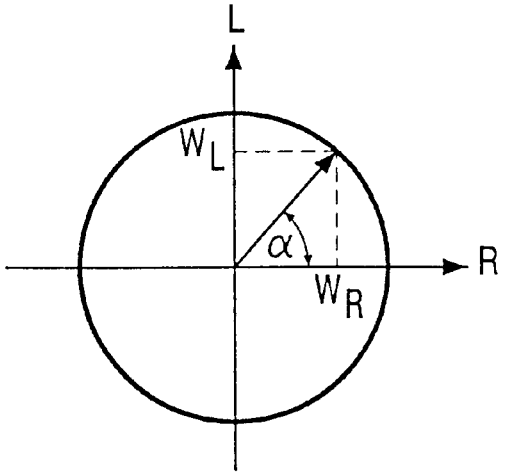
Figure 3B:
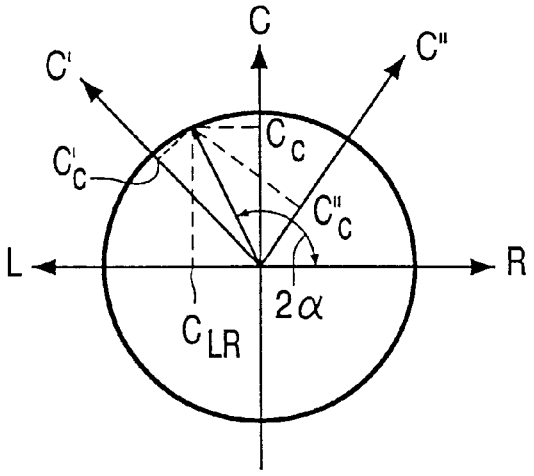
Figure 4:
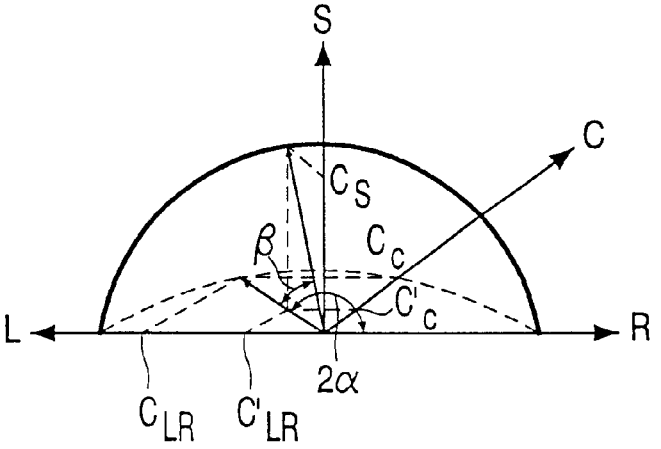

FIGS. 3(*a*) and 3(*b*) show direction vector plots of left and right stereophonic signals; and FIG. 4 outlines space mapping used in generating a surround signal in the multi-channel stereo converter according to the invention.

DETAILED DESCRIPTION OF THE DRAWINGS

Figure 1:
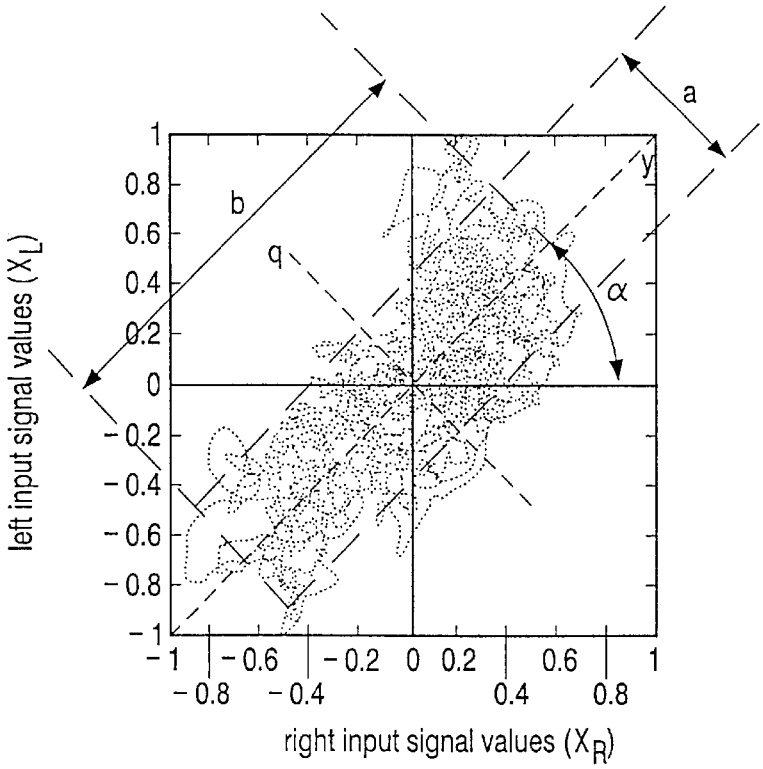
FIG. 1 shows a two dimensional state area defined by a combination of left (L) and right (R) audio signal amplitudes for explaining part of the operation of the multi-channel stereo converter according to the present invention.

FIG. 1 shows a plot of a two-dimensional so called state area defined by momentaneous left (L) and right (R) audio signal amplitudes. Along the vertical axis input signal values of a left (L) audio stereo signal are denoted, while along the horizontal axis input signal values of a right (R) audio stereo signal are denoted. Mono signals emanating from for example speech can be found on a line through the origin of the area making an angle of 45 degrees with the horizontal axis. Stereo music leads to numerous samples shown as dots in the area. The dotted area may have an oblong shape as shown, in which case two orthogonal axes y and q may be defined. Axes y can be seen to have been formed by some average over all dots in the area providing information about a direction of a dominant signal. There are several estimation techniques known to estimate the dominant direction y. The least square method is well known to provide an adequate direction sensing or localization algorithm. Orthogonal to the axes y one may define the axes q, which provides information about an audio signals deviation from the dominant direction y. After determining the direction of these axes y and q, quantities b and a respectively can be determined or estimated, which are quantities defining the dimensions of the dotted area measured along the axes y and q respectively. In addition for example the ratio a/b, or at wish the value of the well known cross correlation ρ of the signals L and R provides stereo magnitude information, which represents a degree of stereo between said audio signals L and R. The cross correlation is defined as:

$$\rho=\Sigma(L-\underline{L})(R-\underline{R})/\{\Sigma(L-\underline{L})^2(R-\underline{R})^2\}^{1/2}$$

where the underscores represent average values. The actual measurement or estimation of the ratio a/b or the cross correlation ρ can take place by any suitable means, and each of these signals can at wish be taken to provide stereo magnitude information.

Figure 2:
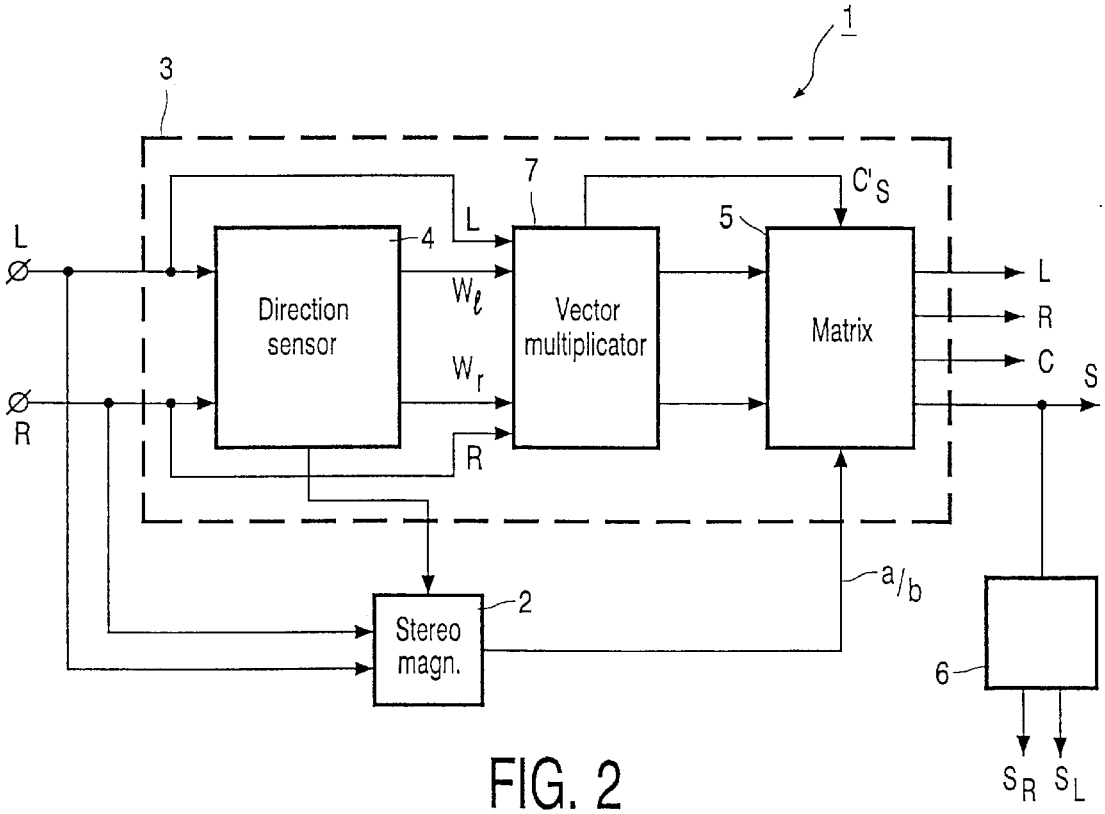
FIG. 2 shows a general outline of several embodiments of the multi-channel stereo converter according to the invention.

FIG. 2 shows a combination of several possible embodiments of a multi-channel stereo converter 1. The converter 1 comprises stereo means in the form of stereo magnitude determining means 2 for generating the stereo information signal, which represents said degree of stereo between the audio signals L and R, as explained above. The converter 1 also comprises transforming means 3 for transforming the audio signals L and R based on said stereo information signal into at least a stereo surround signal S, and/or into at least one audio centre signal C, as will be explained later.

The transforming means 3 comprises a direction sensor circuit 4 which provides information in the form of for example coordinates/weights $w_L$ and $w_R$, or angular information α concerning the direction of axes y in a way explained in the above. The stereo magnitude determining means 2 may use information from the direction sensor circuit 4, if necessary. Further the weights $w_L$ and $w_R$ and the stereo information signal a/b or ρ are used in the transforming means 3 to derive in a first possible embodiment a left L, right R, and a surround signal S therefrom. Thereto the transforming means 3 comprise a matrix means 5. A possible transformation implemented by the matrix means 5 based on the stereo magnitude signal and suggested now by way of example is:

$$\beta=\arcsin(a/b) \text{ with } 0\leqq a/b\leqq 1, \text{ and } 0\leqq\beta\leqq\pi/2.$$

By interpreting β as an angle onto the plane defined by the stereo signals L and R a mapping and three dimensional hemisphere presentation occurs, where the surround signal S is created now, whose axes is orthogonal to the stereo signal axes L and R. In this embodiment of the multi-channel stereo converter 1 the signals L and R are transformed into L, R and S. L and R may be mutual orthogonal as shown in FIG. 3(*a*), or may lie mainly in line as shown in FIGS. 3(*b*) and 4, which will be explained later on.

In a still further embodiment the mono surround signal S may be transformed further by means of one or more decorrelation filters, for example well known Lauridsen decorrelation filters 6. To the filter 6 the mono surround signal S is applied for generating a stereo surround left signal ($S_L$) and a stereo surround right signal ($S_R$).

In general any kind of transformation, either goniometric or not which maps the stereo information signal a/b; or ρ to the angle β, where this angle is between 0 and π/2 is applicable.

FIG. 2 exposes still another embodiment, wherein the stereo converter 1 comprises a vector multiplicator 7 coupled between the direction sensor 4 and the matrix means 5. The multiplicator 7 performs an additional possible transformation or mapping from the weights $w_L$ and $w_R$ shown in FIG. 3(*a*) to new weights $c_{LR}$ and $c_C$ shown in FIG. 4 for creating an audio centre signal C. This could be done by for example doubling the angle α. Principally multiplication by any wanted factor preferably close to 2 will do the job of creating the audio centre signal C. In the matrix means 5 its output signals L, R, C, and S are derived from the momentaneous signal values expressed in terms of the signals y and q and based on a matrix whose coefficients depend on the weights $w_L$ and $w_R$, as well as on the various projection coefficients outlined in FIG. 4.

An example of a possible mapping, known as matrixing, is given in the matrix hereunder, which produces four channel output signals of L, C, R and S, expressed in terms of time samples k, according to:

$$\begin{pmatrix} U_L(k) \\ U_R(k) \\ U_C(k) \\ U_S(k) \end{pmatrix} = \begin{pmatrix} C_L(k) & W_R(k) \\ C_R(k) & -W_L(k) \\ C'c(k) & 0 \\ 0 & C_S(k) \end{pmatrix} \begin{pmatrix} y(k) \\ q(k) \end{pmatrix}$$

where the base signals y(k) and q(k) are computed using a rotation of the input signals in accordance with:

$$y(k)=w_L(k)x_L(k)+w_R(k)x_R(k)$$

$$q(k)=w_R(k)x_L(k)-w_L(k)x_R(k),$$

and $$C_L(k)=\begin{cases} -c'_{LR}(k) & \text{if } c'_{LR}<0 \\ 0 & \text{otherwise} \end{cases}$$

$$C_R(k)=\begin{cases} c'_{LR}(k) & \text{if } c'_{LR}\geq 0 \\ 0 & \text{otherwise.} \end{cases}$$

In general the matrix coefficients of said matrix transformation are based on projections of an actual audio signal on principal axes shown in FIG. 4 of the audio signals (R, L, C, S). These matrix coefficients may however at wish be combined with coefficients which are partly determined on an empirical basis.

The effects of the doubling or multiplication of a combined with the three dimensional surround transformation explained earlier are shown in full in the space mapping of FIG. 4, revealing the audio signals L, R, C, and S, whereas at wish S may be subdivided using filter 6 in the stereo surround left signal ($S_L$) and the stereo surround right signal ($S_R$). The multiplication or possible doubling of α may be applied more times, for example twice.

At wish the exemplified mappings of FIGS. 3(*b*) and/or 4 may be generalized to be applicable to more than one audio centre signal C. In that case in the audio planes of the FIGS. 3(*b*) and 4 additional centre axes for example C' and C" may be defined in which case the actual audio vector can be projected on each of these audio centre axes C, C' and C" revealing the projections $C_C$, $C_{C'}$, and $C_{C''}$ respectively.

Whilst the above has been described with reference to essentially preferred embodiments and best possible modes it will be understood that these embodiments are by no means to be construed as limiting examples of the devices concerned, because various modifications, features and combination of features falling within the scope of the appended claims are now within reach of the skilled person, as explained in the above.

What is claimed is:

1. A multi-channel stereo converter, comprising stereo means for generating an information signal from stereophonic audio signals (L, R) and transforming means coupled to the stereo means for transforming said audio signals (L, R) to a further audio signal (C; S), characterized in that the stereo means are stereo magnitude determining means for generating a stereo information signal (a/b; ρ), which represents a degree of stereo between said audio signals (L, R), and that the transforming means are embodied for transforming said audio signals (L, R) based on said stereo information signal (a/b; ρ) into at least a surround signal (S).

2. The multi-channel stereo converter according to claim 1, characterized in that the transforming means use a relation for said transformation which maps the stereo information signal (a/b; ρ) to an angle (β) onto an audio signals defined plane.

3. The multi-channel stereo converter according to one of the claims 1, characterized in that said transformation uses a goniometric relation.

4. The multi-channel stereo converter according to claim 1, characterized in that the transforming means are embodied for additionally transforming said audio signals (L, R) from an orthogonal representation to a representation, wherein said audio signals (L, R) lie on a straight line, thus revealing an additional audio centre signal (C).

5. The multi-channel stereo converter according to claim 4, characterized in that said additional transformation comprises a vector multiplication with a multiple which lies around two.

6. The multi-channel stereo converter according to claim 1, characterized in that said transformation and/or additional transformation perform(s) a matrix transformation.

7. The multi-channel stereo converter according to claim 6, characterized in that matrix coefficients of said matrix transformation are based on projections of an actual audio signal on principal axes of the audio signals (R, L, C, S).

8. The multi-channel stereo converter according to claim 1, characterized in that the stereo converter is provided with one or more decorrelation filters, for example Lauridsen decorrelation filters, to which filters the surround signal (S) is applied for generating a stereo surround left signal ($S_L$) and a stereo surround right signal ($S_R$).

9. A method for generating audio signals from stereophonic audio signals (L, R), wherein an information signal is derived from said audio signals (L, R) and used for transforming said audio signals (L, R) to such an audio signal (S), characterised in that the information signal is a stereo information signal (a/b; ρ), which represents a degree of stereo between said audio signals (L, R), and that based on said stereo information signal (a/b; ρ) said audio signals (L, R) are transformed into at least a surround signal (S).

* * * * *